US008608509B2

(12) United States Patent
Shimada et al.

(10) Patent No.: US 8,608,509 B2
(45) Date of Patent: Dec. 17, 2013

(54) ELECTRICAL CONNECTOR

(75) Inventors: Yoshinobu Shimada, Tokyo (JP); Kosuke Ozeki, Tokyo (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 31 days.

(21) Appl. No.: 13/402,750

(22) Filed: Feb. 22, 2012

(65) Prior Publication Data

US 2012/0220171 A1 Aug. 30, 2012

(30) Foreign Application Priority Data

Feb. 22, 2011 (JP) ..... 2011-035991

(51) Int. Cl.
*H01R 13/648* (2006.01)

(52) U.S. Cl.
USPC ..... 439/607.01

(58) Field of Classification Search
USPC ..... 439/607.01, 607.04, 607.36, 607.31, 439/79, 660, 260
See application file for complete search history.

(56) References Cited

U.S. PATENT DOCUMENTS 4,623,211 A * 11/1986 Dambach et al. ..... 439/607.4
7,134,912 B2 * 11/2006 Kamata et al. ..... 439/607.31
7,344,411 B2 * 3/2008 Ker et al. ..... 439/607.36
7,445,503 B1 * 11/2008 Zhang ..... 439/607.01
7,766,680 B2 * 8/2010 Suzuki et al. ..... 439/260
7,878,843 B2 * 2/2011 Zhang ..... 439/497
7,934,957 B1 * 5/2011 Nakajima et al. ..... 439/607.49
7,993,151 B2 * 8/2011 Chuo et al. ..... 439/260
8,172,610 B2 * 5/2012 Kurachi ..... 439/578
8,194,408 B2 * 6/2012 Chou et al. ..... 361/737
8,241,065 B2 * 8/2012 Ikari et al. ..... 439/607.41
8,408,928 B2 * 4/2013 Won et al. ..... 439/260
2005/0260871 A1 * 11/2005 Kamata et al. ..... 439/79

FOREIGN PATENT DOCUMENTS

JP 2008-052993 A 3/2008
JP 2008-192574 A 8/2008

* cited by examiner

*Primary Examiner* — Alexander Gilman
(74) *Attorney, Agent, or Firm* — Studebaker & Brackett PC

(57) ABSTRACT

An electrical connector having a housing provided with an opening through which a flat circuit device is inserted into the housing, a plurality of conductive contacts arranged on the housing for contacting with connecting terminals on the flat circuit device in the housing, and a shell member mounted on the housing and provided therein with a holding portion for holding the flat circuit device in the housing and a manipulatable releasing portion for releasing the flat circuit device from holding by the holding portion, wherein the holding portion is constituted to extend from a portion of the shell member provided for covering one of opposite plate-shaped portions of the housing into an inside of the housing and to have an engaging projection formed thereon for selectively engaging with and disengaging from the flat circuit device.

19 Claims, 11 Drawing Sheets

ELECTRICAL CONNECTOR

BACKGROUND OF THE INVENTION

1. Field of the Invention

The present invention relates generally to an electrical connector, and more particularly to an improvement in an electrical connector operative to connect electrically connecting terminals provided on a flat circuit device, such as a flexible printed circuit board (hereinafter, referred to as an FPC) or a flexible flat cable assembly (hereinafter, referred to as an FFC), with an electrical device such as a solid circuit board, which has a housing provided to be mounted on the electrical device such as the solid circuit board and having an opening provided thereon through which the flat circuit device is inserted into the housing, holding means for engaging with the flat circuit device inserted in the housing to hold the same to be prevented from getting out of the housing unwillingly, and a plurality of conductive contacts provided for coming into contact with the connecting terminals on the flat circuit device inserted in the housing to put the same in electrical connection with the electrical device such as the solid circuit board.

2. Description of Related Art Including Information Disclosed under 37 CFR 1.97 and 37 CFR 1.98

A flat circuit device, such as a relatively small-sized FPC or FFC, used in various kinds of electronic apparatus is often mounted on a solid circuit board, on which various electrical parts are directly mounted, with an electrical connector which is fixed to and connected electrically with the solid circuit board. The electrical connector has a plurality of conductive contacts, an end portion of each of which is connected electrically with a conductive circuit pattern portion formed on the solid circuit board and which are provided for coming into contact with connecting terminals provided on the flat circuit device. The electrical connector thus provided with the conductive contacts is operative to couple electrically, through the conductive contacts, each of the connecting terminals provided on the flat circuit device with the conductive circuit pattern portion formed on the solid circuit board.

A first type of previously proposed electrical connector which is used for connecting electrically a flat circuit device, such as an FPC, with a solid circuit board, has a housing made of insulator to be mounted on the solid circuit board and having an opening through which at least a part of the flat circuit device is inserted into the housing. On the housing, a plurality of conductive contacts are provided to be arranged along the opening provided also on the housing. These conductive contacts are operative to come into contact respectively with a plurality of connecting terminals provided on the flat circuit device when the flat circuit device is inserted in the housing through the opening provided thereon. The previously proposed electrical connector of the first type is also provided with a shell member which covers wholly or partially the housing and is grounded to be operative to contribute to adjustment on characteristic impedance of each of the conductive contacts and to shield the conductive contacts in the housing from electromagnetic wave noises coming from the outside. The previously proposed electrical connector of the first type is further provided with an actuator which is set to be rotatable in regard to the housing so as to engage with each of the conductive contacts arranged in the housing. When the actuator is rotated in a first direction in regard to the housing, the conductive contacts are put in press-contact respectively with the connecting terminals provided on the flat circuit device, and then, when the actuator is rotated in a second direction opposite to the first direction in regard to the housing, the conductive contacts put in press-contact respectively with the connecting terminals provided on the flat circuit device are released from the press-contact with the connecting terminals. With the conductive contacts put in press-contact respectively with the connecting terminals provided on the flat circuit device inserted in the housing, the flat circuit device is put in electrical connection with the solid circuit board.

A second type of previously proposed electrical connector which is used for connecting electrically a flat circuit device with a solid circuit board is provided with a housing to be mounted on the solid circuit board, a plurality of conductive contacts and a shell member in such a manner as mentioned above, but is not provided with an actuator rotatable in regard to the housing. In the previously proposed electrical connector of the second type thus constituted, when the flat circuit device is inserted into the housing through an opening provided thereon, each of the conductive contacts provided in the housing to be arranged along the opening is automatically put in press-contact with a corresponding one of connecting terminals provided on the flat circuit device. That is, the flat circuit device is put in electrical connection with the main solid circuit board by means of only inserting correctly the flat circuit device into the housing through the opening provided thereon.

In the previously proposed electrical connector with or without the actuator rotatable in regard to the housing, when the flat circuit device is inserted into the housing through the opening provided thereon and the conductive contacts arranged on the housing are put in press-contact with the connecting terminals provided on the flat circuit device so that the flat circuit device is put in electrical connection with the solid circuit board, it is required that the flat circuit device inserted in the housing is prevented from getting out of the housing unwillingly. As a matter of course, it is necessary for the flat circuit device inserted in the housing to be held stably so as not to get out of the housing unwillingly in order to keep the conductive contacts arranged on the housing properly in a condition of press-contact with the connecting terminals provided on the flat circuit device.

There has been also proposed previously an electrical connector belonging to the above mentioned first type having the housing, the conductive contacts, the shell member and the actuator, which is provided also with holding means for engaging with a flat circuit device, such as an FPC or an FFC, inserted in the housing so as to hold the same to be prevented from getting out of the housing unwillingly, as shown in, for example, the Japanese patent application published before examination under publication number 2008-52993 (hereinafter, referred to as published patent document 1).

Besides, there has been further proposed previously an electrical connector belonging to the above mentioned second type having the housing, the conductive contact and the shell member except the actuator rotatable in regard to the housing, which is provided also with holding means for engaging with a flat circuit device, such as an FPC or an FFC, inserted in the housing so as to hold the same to be prevented from getting out of the housing unwillingly, as shown in, for example, the Japanese patent application published before examination under publication number 2008-192574 (hereinafter, referred to as published patent document 2).

In the electrical connector shown in the published patent document 1, the holding means (a locking portion 11*c*) is formed in a part of the shell member (a shield plate 11) to be able to seesaw with an engaging end portion (a claw portion 11*d*) curved to the inside of the shell member. The holding means is operative to shift its position in response to a movement of the actuator (an actuator 9) provided to be rotatable in regard to the housing (a housing 3).

Then, when the actuator is rotated in a first direction in regard to the housing after the flat circuit device (an FPC 21) is inserted into a receptacle space (an FPC receptacle space 34) provided in the housing, each of the conductive contacts (first contacts 5 and second contacts 6) provided in the housing is caused by a cam (a cam portion 92 or 93) formed on the actuator to shift its position so as to be put in press-contact with a corresponding one of connecting terminals provided on the flat circuit device inserted in the housing and the holding means is caused by a cam (a cam portion 94) formed on the actuator to shift its position so as to cause the engaging end portion of the holding means to engage with an engaging portion (a recess 21*a*) formed on the flat circuit device. As a result, the flat circuit device inserted in the housing is prevented from getting out of the housing unwillingly.

After that, when the actuator is rotated in a second direction opposite to the first direction in regard to the housing under a condition wherein the engaging end portion of the holding means is put in engagement with the engaging portion formed on the flat circuit device, the cam (the cam portion 94) formed on the actuator allows the holding means to release the engaging end portion of the holding means from the engagement with the engaging portion formed on the flat circuit device. As a result, the flat circuit device is put in a condition to be able to get out of the housing.

Further, in the electrical connector shown in the published patent document 2, the shell member (a shell 4) is provided to be rotatable in regard to the housing (a housing body 2) and the holding means (a leg portion 46) in the form of a leaf spring is formed in a part of the shell member. The holding means has an engaging projection (44) formed at an end of the holding means to be curved to the inside of the shell member.

When the flat circuit device (an FPC) is inserted into the housing through the opening (an opening 21) provided thereon under a condition wherein the shell member is positioned to keep lying down on the housing so as to be close in its entirety to the housing, each of the conductive contacts (upper contacts 31 and lower contacts 32) provided in the housing is caused to be put in press-contact with a corresponding one of connecting terminals provided on the flat circuit device inserted in the housing and the engaging projection formed on the holding means is caused to engage with an engaging portion (an FPC engaging hole 2) provided on the flat circuit device. As a result, the flat circuit device inserted in the housing is prevented from getting out of the housing unwillingly.

After that, when the shell member is rotated to be positioned to keep rising from the housing under a condition wherein the engaging projection formed on the holding means is put in engagement with the engaging portion formed on the flat circuit device, the holding means formed in the shell member shifts its position in response to a movement of the shell member so as to release the engaging projection provided on the holding means from the engagement with the engaging portion formed on the flat circuit device. As a result, the flat circuit device is put in a condition to be able to get out of the housing.

In each of the electrical connectors thus proposed previously, which has the holding means operative to prevent the flat circuit device inserted in the housing from getting out of the housing unwillingly, the holding means is provided to be operative to shift its position in response to rotational movements of the actuator provided to be rotatable in regard to the housing, or the shell member for covering wholly or partially the housing is provided to be rotatable in regard to the housing and the holding means is formed in a part of the shell member to be operative to prevent the flat circuit device inserted in the housing from getting out of the housing unwillingly.

In the case of the previously proposed electrical connector which has the holding means operative to shift its position in response to the rotational movements of the actuator provided to be rotatable in regard to the housing, it is required that the holding means and the actuator are provided as separate parts independent from each other and this results in problems or disadvantages that miniaturization in the electrical connector is undesirably hindered, the number of constitutive parts of the electrical connector increases undesirably and a production cost of the electrical connector rises disagreeably. Besides, it is necessary, for causing the holding means to engage with or disengage from the flat circuit device inserted in the housing, to rotate the actuator in regard to the housing and this results in undesirable increase in an open space around the electrical connector.

In the case of the previously proposed electrical connector which has the shell member provided to be rotatable in regard to the housing and the holding means formed in the part of the shell member, since the shell member is operative to rotate in regard to the housing, any portion of the shell member is not able to be used for fastening the electrical connector to the main solid circuit board so that a separate holding-down member for fastening the electrical connector to the main solid circuit board is required and this results in problems or disadvantages that miniaturization in the electrical connector is undesirably hindered, the number of constitutive parts of the electrical connector increases undesirably and a production cost of the electrical connector rises disagreeably.

BRIEF SUMMARY OF THE INVENTION

Accordingly, it is an object of the present invention to provide an electrical connector used for connecting electrically a flat circuit device, such as an FPC or an FFC, with a solid circuit board, which comprises a housing mounted on the solid circuit board and provided thereon with an opening through which the flat circuit device is inserted into the housing, a plurality of conductive contacts provided to be arranged on the housing and a shell member covering partially the housing, and which avoids the aforementioned disadvantages encountered with the prior art.

Another object of the present invention is to provide an electrical connector used for connecting electrically a flat circuit device, such as an FPC or an FFC, with a solid circuit board, which comprises a housing mounted on the solid circuit board and provided thereon with an opening through which the flat circuit device is inserted into the housing, a plurality of conductive contacts provided to be arranged on the housing and a shell member covering partially the housing, and in which the flat circuit device inserted in the housing can be put in holding by a holding member formed in the shell member to be surely prevented from getting out of the housing unwillingly and then released from the holding by the holding member to be able to get out of the housing with a structure in which the electrical connector can be miniaturized on the whole and the number of structural parts can be reduced.

A further object of the present invention is to provide an electrical connector used for connecting electrically a flat circuit device, such as an FPC or an FFC, with a solid circuit board, which comprises a housing mounted on the solid circuit board and provided thereon with an opening through which a flat circuit device is inserted into the housing, a plurality of conductive contacts provided to be arranged on the housing and a shell member covering partially the housing, and in which the flat circuit device inserted in the housing can be surely released from holding by a holding portion formed in the shell member by means of a quite simple and easy manipulation inflicted on the shell member.

According to the present invention, as claimed in any one of claims, there is provided an electrical connector, which comprises a housing made of insulator and provided thereon with an opening through which a flat circuit device, such as an FPC or an FFC, is inserted into the housing and which opens on a first end portion of the housing, a plurality of conductive contacts arranged on the housing, each of which has a connecting terminal portion projecting from a second end portion opposite to the first end portion of the housing to the outside of the housing and a press-contacting portion positioned in the housing to be operative to come into press-contact with a connecting terminal provided on the flat circuit device inserted in the housing through the opening provided thereon, and a shell member mounted on the housing for covering partially the same and provided in a body therein with a holding portion operative to be put in engagement with the flat circuit device inserted in the housing for holding the same and a manipulatable releasing portion formed to be manipulated for releasing the holding portion from the engagement with the flat circuit device inserted in the housing, wherein the holding portion is constituted to extend to be bent from an end of a portion of the shell member provided for covering a first plate-shaped portion of the housing toward a second plate-shaped portion opposite to the first plate-shaped portion of the housing so as to reach into an inside of the housing and to have an engaging projection formed thereon to be moved selectively for engaging with and disengaging from the flat circuit device inserted in the housing, and the manipulatable releasing portion is constituted with the portion of the shell member provided for covering the first plate-shaped portion of the housing to be operative to shift its position with the holding portion in a direction intersecting a direction along which the conductive contacts are arranged.

In the electrical connector thus constituted in accordance with the present invention, when the flat circuit device on which the connecting terminals are provided is inserted into the housing thorough the opening provided thereon, the press-contacting portion of each of the conductive contacts arranged on the housing comes into press-contact with a corresponding one of the connecting terminals provided on the flat circuit device inserted in the housing and the holding portion formed in a body in the shell member is put in engagement with the flat circuit device inserted in the housing to hold the same. The engaging projection formed on the holding portion is operative to engage with the flat circuit device inserted in the housing when the holding portion is put in the engagement with the flat circuit device inserted in the housing for holding the same. As a result, the flat circuit device inserted in the housing is held by the holding member so as to be prevented from getting out of the housing unwillingly and the conductive contacts arranged on the housing are stably kept in contact with the connecting terminals provided on the flat circuit device inserted in the housing.

Then, the manipulatable releasing portion formed in a body in the shell member is manipulated, for example, with pressure directed toward the housing for releasing the holding portion from the engagement with the flat circuit device inserted in the housing. With such a manipulation, the manipulatable releasing portion is shifted in its position with the holding portion, for example, to approach to the housing so that the engaging projection formed on the top end of the holding portion disengages from the flat circuit device inserted in the housing. As a result, the flat circuit device inserted in the housing is released from holding by the holding portion so as to be able to get out of the housing.

Functions or roles of the respective portions of the electrical connector constituted as mentioned above in accordance with the present invention are further explained in the concrete as follows, for example.

In an embodiment of electrical connector according to the present invention, each of the holding portion and the releasing portion of the shell member is formed to constitute a resilient swingable portion.

The engaging projection of the holding portion is formed, for example, on an end of the holding portion on the side of the opening provided on the housing.

The holding portion is, for example, operative to swing with a linear fulcrum placed at a root of the holding portion connected with the end of the portion of the shell member provided for covering the first plate-shaped portion of the housing and the manipulatable releasing portion is, for example, operative to swing with a linear fulcrum placed at a portion of the shell member close to the second end portion of the housing. The engaging projection of the holding portion is shaped to project from the holding portion in a direction to the first plate-shaped portion of the housing from the second plate-shaped portion of the housing.

Accordingly, for example, when the manipulatable releasing portion is manipulated with the pressure directed toward the housing under a condition wherein the engaging projection of the holding portion engages from the side of the second plate-shaped portion of the housing with the flat circuit device inserted in the housing so that the holding portion is put in the engagement with the flat circuit device inserted in the housing for holding the same, an edge portion of the manipulatable releasing portion on the side of the opening provided on the housing is shifted in its position toward the second plate-shaped portion of the housing and thereby the end of the holding portion on the side of the opening provided on the housing, on which the engaging projection id formed, is also shifted in its position toward the second plate-shaped portion of the housing. As a result, the engaging projection formed on the end of the holding portion on the side of the opening provided of the housing is moved toward the second plate-shaped portion of the housing to disengage from the flat circuit device inserted in the housing. After that, when the manipulatable releasing portion is released from the manipulation with the pressure directed toward the housing, each of the holding portion and the manipulatable releasing portion is restored to its condition prior to the manipulation inflicted on the manipulatable releasing portion by means of its own restoring resiliency.

The engaging projection of the holding portion is, for example, provided with a slant surface ascending in a direction from the first end portion to the second end portion of the housing, or an end portion on the side of the first end portions of the housing positioned to come into contact with or close to the first end portion of the housing.

The manipulatable releasing portion is, for example, provided with at least one groove or protuberance extending in the direction along which the conductive contacts are arranged, a bent portion extending to be bent from the edge of the manipulatable releasing portion on the side of the opening provided on the housing toward the second plate-shaped portion of the housing for shutting a space between the first plate-shaped portion of the housing and the portion of the shell member provided for covering the first plate-shaped portion of the housing, an engaging bent portion extending to be bent from the edge of the manipulatable releasing portion on the side opposite to the side of the opening provided on the housing toward the second plate-shaped portion of the housing for engaging with a part of the second end portion of the housing, or an engaging portion for engaging with a projection formed on the first plate-shaped portion of the housing.

Further, in the embodiment of electrical connector according to the present invention, the shell member has a connecting portion for connecting the portion thereof provided for covering the first plate-shaped portion of the housing with another portion thereof provided to be close to the second plate-shaped portion of the housing at the side of the second end portion of the housing. The connecting portion of the shell member is subjected to resilient deformation responding to swinging movements of the manipulatable releasing portion.

In addition, in the embodiment of electrical connector according to the present invention, the housing has a claw-shaped holding portion for engaging with the portion of the shell member in which the holding portion is formed so as to hold the shell member or a portion thereof provided for covering an end face portion of the shell member which is a carrier-cut portion.

With the electrical connector constituted in accordance with the present invention, as described above, when the flat circuit device, such as the FPC, the FFC and so on, is inserted into the housing thorough the opening provided thereon, the press-contacting portion of each of the conductive contacts arranged on the housing comes into press-contact with the corresponding one of the connecting terminals provided on the flat circuit device inserted in the housing and the holding portion formed in a body in the shell member is put in engagement with the flat circuit device inserted in the housing for holding the same. As a result, the flat circuit device inserted in the housing is held by the holding portion of the shell member so as to be prevented from getting out of the housing unwillingly and the conductive contacts arranged on the housing are stably kept in electrical connection with the connecting terminals provided on the flat circuit device inserted in the housing.

Then, when the manipulatable releasing portion formed in a body in the shell member in addition to the holding portion is manipulated for releasing the holding portion from the engagement with the flat circuit device inserted in the housing under a condition wherein the flat circuit device inserted in the housing is put in holding by the holding portion, the manipulatable releasing portion is shifted in its position with the holding portion in the direction intersecting the direction along which the conductive contacts are arranged. The manipulatable releasing portion thus shifted in its position causes the engaging projection formed on the holding portion to disengage from the flat circuit device so that the holding portion is released from the engagement with the flat circuit device. As a result, the flat circuit device inserted in the housing is released from the holding by the holding portion so as to be able to get out of the housing.

Accordingly, with the electrical connector according to the present invention, the flat circuit device inserted in the housing can be put in the holding by the holding portion formed in a body in the shell member to be surely prevented from getting out of the housing unwillingly and then released from the holding by the holding portion to be able to get out of the housing with an improved structure in which the holding portion and the manipulatable releasing portion are formed in a body in the shell member and with which the electrical connector can be miniaturized on the whole and the number of structural parts can be reduced.

In the electrical connector thus constituted in accordance with the present invention, since the manipulatable releasing portion which is constituted with the portion of the shell member provided for covering the first plate-shaped portion of the housing to be operative to shift its position with the holding portion in the direction intersecting the direction along which the conductive contacts are arranged and, for example, to elongating in the direction along which the conductive contacts are arranged, is manipulated to shift its position in the direction intersecting the direction along which the conductive contacts are arranged for releasing the holding portion from the engagement with the flat circuit device, the flat circuit device inserted in the housing can be surely released from the holding by the holding portion by means of a quite simple and easy manipulation inflicted on the manipulatable releasing portion of the shell member.

With the embodiment of electrical connector according to the present invention in which each of the holding portion and the releasing portion of the shell member is formed to constitute the resilient swingable portion, when the manipulatable releasing portion is released from the manipulation, for example, with the pressure directed toward the housing, for releasing the holding portion from the engagement with the flat circuit device inserted in the housing, each of the holding portion and the manipulatable releasing portion can be restored to its condition prior to the manipulation inflicted on the manipulatable releasing portion by means of its own restoring resiliency.

With the embodiment of electrical connector according to the present invention in which the engaging projection of the holding portion is shaped to project from the holding portion in the direction to the first plate-shaped portion of the housing from the second plate-shaped portion of the housing, when an undesirable force is exerted on the flat circuit device inserted in the housing and held by the holding portion to pull the same out of the housing, the engaging projection of the holding portion is shifted in its position in the direction to the first plate-shaped portion of the housing from the second plate-shaped portion of the housing so as to strengthen the engagement with the flat circuit device.

With the embodiment of electrical connector according to the present invention in which the engaging projection of the holding portion is provided with the slant surface ascending in a direction from the first end portion to the second end portion of the housing, it is avoided that the flat circuit device on the way of inserting into the housing is disturbed by the engaging projection of the holding portion.

With the embodiment of electrical connector according to the present invention in which the engaging projection of the holding portion is provided with the end portion thereof on the side of the first end portion of the housing positioned to come into contact with or close to the first end portion of the housing on which the opening opens, when an undesirable force is exerted on the flat circuit device inserted in the housing and held by the holding portion to pull the same out of the housing, the end portion of the engaging projection of the holding portion is restricted by the first end portion of the housing so that the holding portion is prevented from shifting undesirably its position and therefore it is avoided that the flat circuit device gets out of the housing.

With the embodiment of electrical connector according to the present invention in which the manipulatable releasing portion is provided with the groove or protuberance extending in the direction along which the conductive contacts are arranged, the manipulatable releasing portion is reinforced and made easy to be manipulated with the groove or protuberance.

With the embodiment of electrical connector according to the present invention in which the manipulatable releasing portion is provided with a bent portion extending to be bent from the edge of the manipulatable releasing portion on the side of the opening provided on the housing toward the second plate-shaped portion of the housing for shutting the space between the first plate-shaped portion of the housing and the portion of the shell member provided for covering the first plate-shaped portion of the housing, since the space between the housing and the shell member is shut up by the bent portion of the manipulatable releasing portion, it is avoided that the flat circuit device is not inserted into the opening provided on the housing but inserted wrongly into the space between the housing and the shell member.

With the embodiment of electrical connector according to the present invention in which the manipulatable releasing portion is provided with the engaging bent portion extending to be bent from the edge of the manipulatable releasing portion on the side opposite to the side of the opening provided on the housing toward the second plate-shaped portion of the housing for engaging with the part of the second end portion of the housing, the engaging bent portion of the manipulatable releasing portion is operative to engage with the part of the second end portion of the housing and therefore the manipulation on the manipulatable releasing portion for moving the edge of the manipulatable releasing portion on the side of the opening provided on the housing to approach to the housing can be easily carried out and the manipulatable releasing portion is prevented from deforming.

With the embodiment of electrical connector according to the present invention in which the manipulatable releasing portion is provided with the engaging portion thereof for engaging with the projection formed on the first plate-shaped portion of the housing, when the manipulatable releasing portion is manipulated so that the edge of the manipulatable releasing portion on the side of the opening provided on the housing is moved to approach to the housing, the projection formed on the first plate-shaped portion of the housing is operative to project through the engaging portion of the manipulatable releasing portion and with the projection thus provided it can be easily detected that the manipulatable releasing portion is put in manipulation for causing the edge thereof on the side of the opening provided on the housing to approach to the housing.

With the embodiment of electrical connector according to the present invention wherein the shell member has the connecting portion for connecting the portion thereof provided for covering the first plate-shaped portion of the housing with another portion thereof provided to be close to the second plate-shaped portion of the housing at the side of the second end portion of the housing and the connecting portion of the shell member is subjected to resilient deformation responding to swinging movements of the manipulatable releasing portion, the manipulatable releasing portion can be easily deformed resiliently with the manipulation thereon for causing the edge thereof on the side of the opening provided on the housing to approach to the housing.

Further, with the embodiment of electrical connector according to the present invention in which the housing has the claw-shaped holding portion for engaging with the portion of the shell member in which the holding portion is formed so as to hold the shell member, the shell member is prevented from shifting its position undesirably in regard to the housing.

Besides, with the embodiment of electrical connector according to the present invention in which the housing has the portion thereof provided for covering the end face portion of the shell member which is the carrier-cut portion, since the end face portion of the shell member which is the carrier-cut portion is covered by the portion of the housing, for example, it is avoided that an operator who manipulates the manipulatable releasing portion is wounded by the end face portion of the shell member which is the carrier-cut portion.

The above, and other objects, features and advantages of the present invention will become apparent from the following detailed description taken in conjunction with the accompanying drawings.

DETAILED DESCRIPTION OF THE INVENTION

Figure 1:
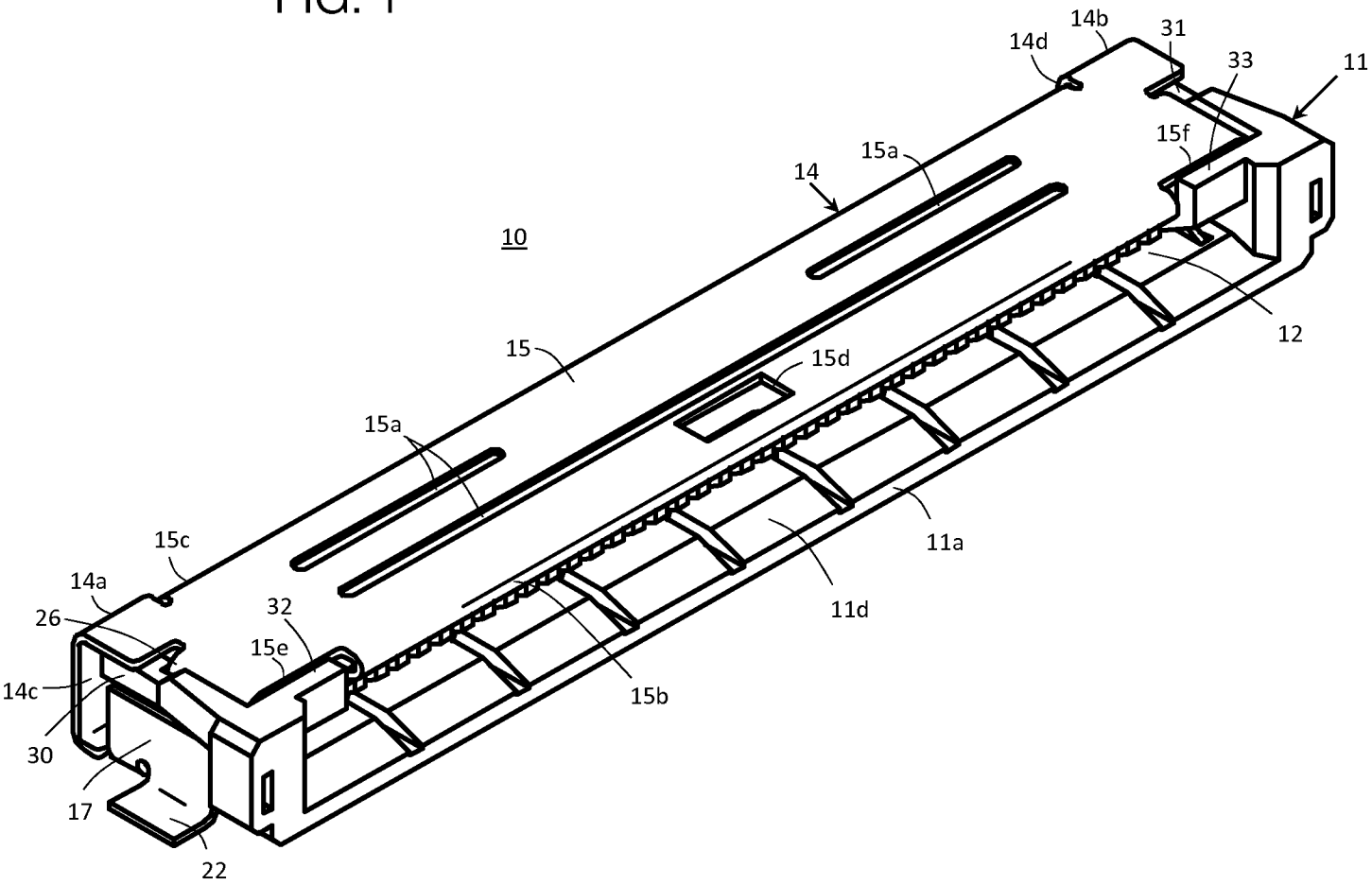
FIG. 1 is a schematic front, top and left side perspective view showing an embodiment of electrical connector according to the present invention.
Figure 2:
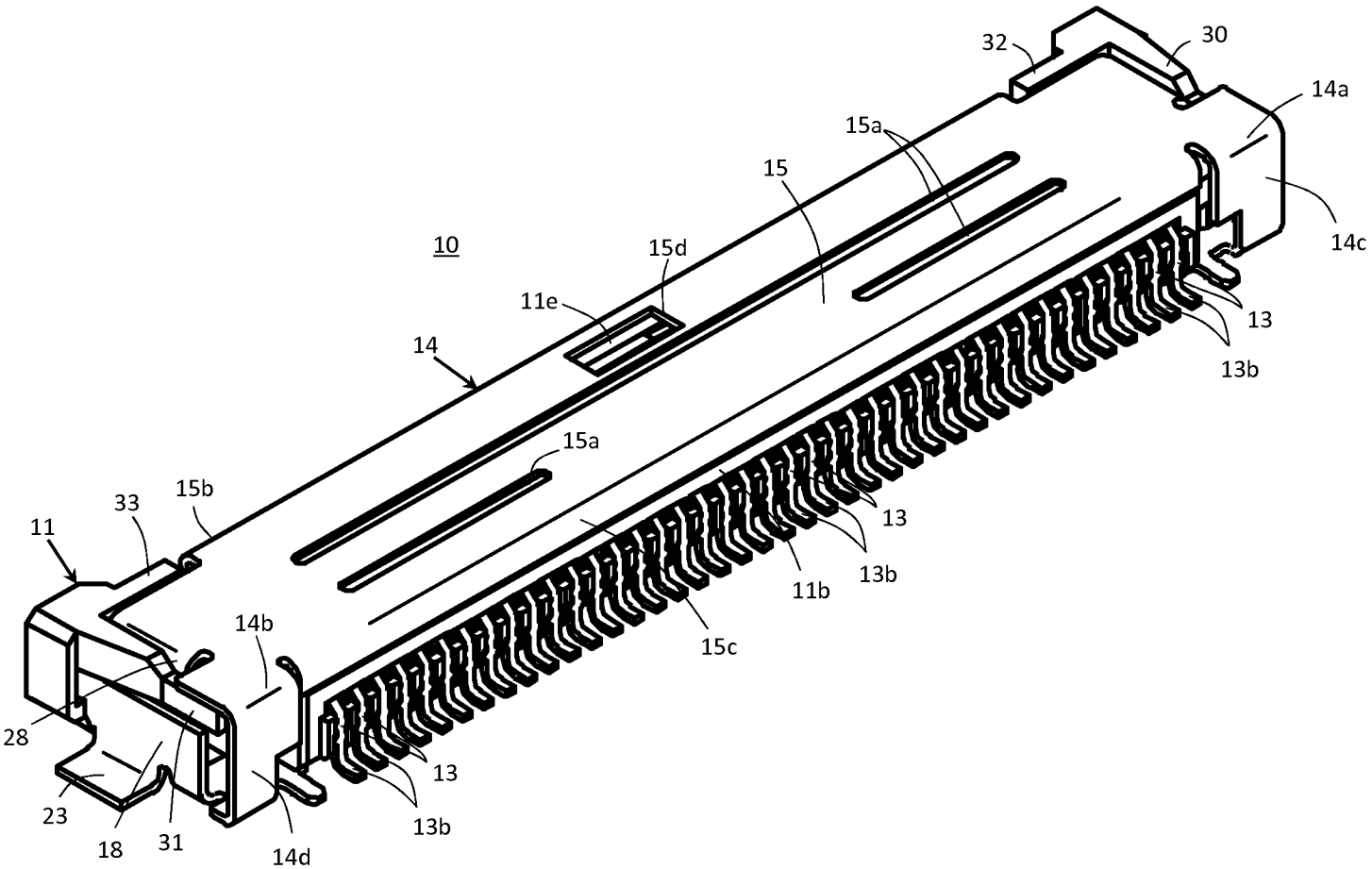
FIG. 2 is a schematic rear, top and right side perspective view showing the embodiment shown in FIG. 1.
Figure 3:
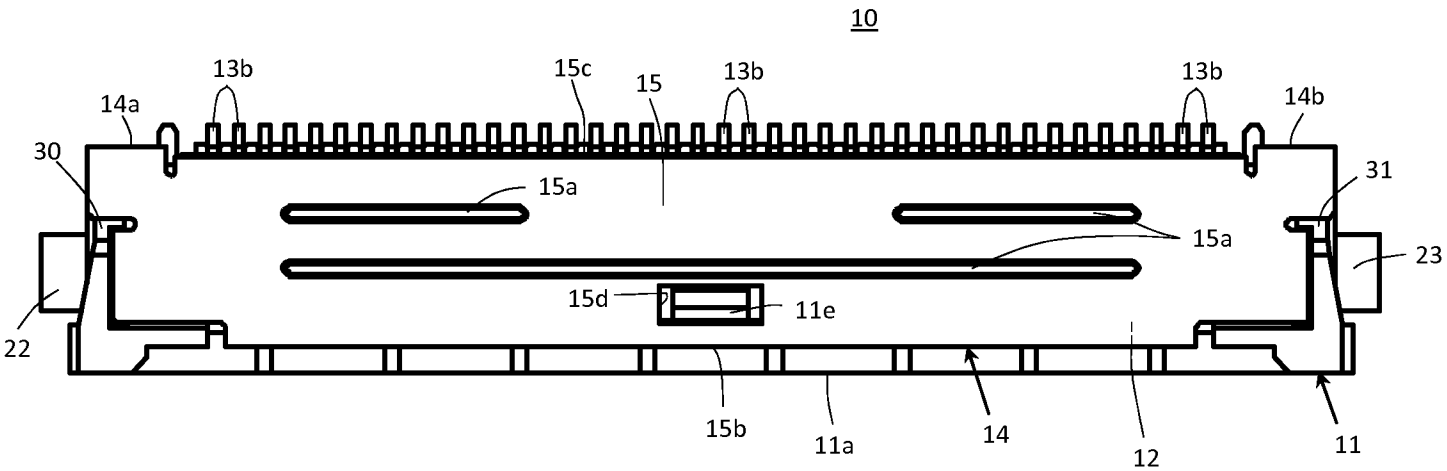
FIG. 3 is a schematic plan view showing the embodiment shown in each of FIGS. 1 and 2.
Figure 4:
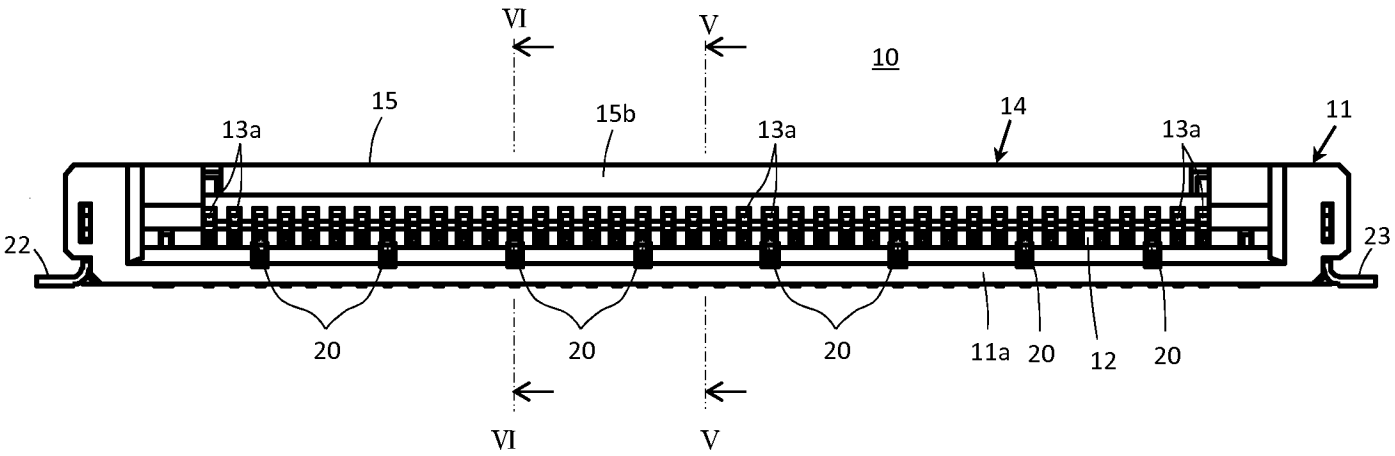
FIG. 4 is a schematic front view showing the embodiment shown in each of FIGS. 1 and 2.

Each of FIG. 1 which is a schematic front, top and left side perspective view, FIG. 2 which is a schematic rear, top and right side perspective view, FIG. 3 which is a schematic plan view and FIG. 4 which is a schematic front view, shows an embodiment of electrical connector according to the present invention.

In FIGS. 1 to 5, an electrical connector 10 which constitutes the embodiment of electrical connector according to the present invention is shown. FIG. 3 is a plan view showing the electrical connector 10 and FIG. 4 is a front view showing the electrical connector 10. Hereinafter, front and rear sides are defined respectively on the lower and upper sides in FIG. 3 and upper, lower, left and right directions are defined on the basis of the front view of the electrical connector 10 shown in FIG. 4.

Referring to FIGS. 1 to 4, the electrical connector 10 has a housing 11 made of, for example, insulator such as plastics or the like. The housing 11 has a front end portion 11*a* and a rear end portion 11*b* which constitute a pair of first and second end portions of the housing 11 opposite to each other, and an upper plate-shaped portion 11*c* (shown in FIGS. 5 and 6 explained later) and a lower plate-shaped portion 11*d* (shown in FIGS. 5 and 6 explained later) which constitute a pair of first and second plate-shaped portions of the housing 11 opposite to each other. Further, the housing 11 is provided thereon with an opening 12 which opens on the front end portion 11*a* of the housing 11 and extends from the front end portion 11*a* of the housing 11 through an inside of the housing 11 toward the rear end portion 11*b* of the housing 11. Therefore, the upper plate-shaped portion 11*c* of the housing 11 and the lower plate-shaped portion 11*d* of the housing 11 face each other with the opening 12 between in the upper and lower directions.

When the electrical connector 10 is put in practical use, the housing 11 is mounted on a solid circuit board in an electronic apparatus (not shown in the drawings) with the lower plate-shaped portion 11*d* thereof facing the solid circuit board so that the electrical connector 10 is fixed in its entirety to the solid circuit board. For example, an FPC constituting a flat circuit device as explained later is inserted through the opening 12 into the housing 11 which is mounted on the solid circuit board.

Figure 5:
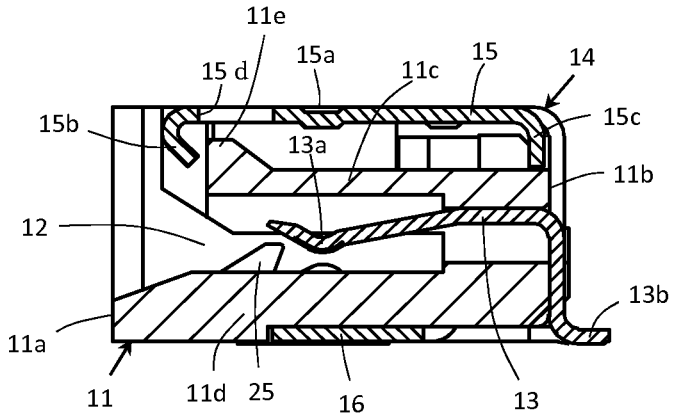
FIG. 5 is a schematic cross sectional view taken along line V-V on FIG. 4.
Figure 6:
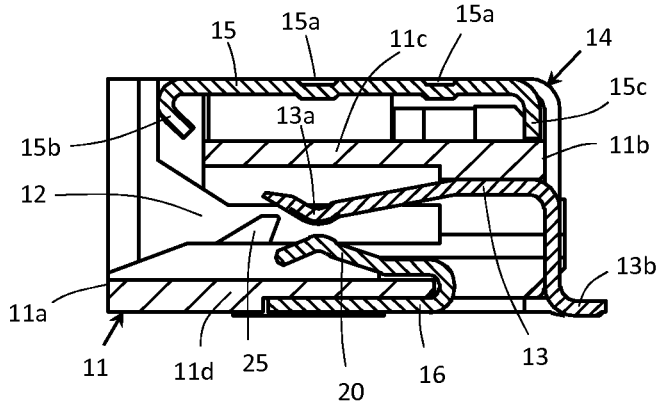
FIG. 6 is a schematic cross sectional view taken along line VI-VI on FIG. 4.

A plurality of conductive contacts 13, each of which is made of resilient conductive material, are provided on the housing 11 of the electrical connector 10 to be arranged in a longitudinal direction of the housing 11. Each of the conductive contacts 13 has a press-contacting portion 13*a* positioned in the housing 11 and a connecting terminal portion 13*b* projecting from the rear end portion 11*b* of the housing 11 to the outside of the housing 11, as shown in FIG. 4 and FIGS. 5 and 6 which are the schematic cross sectional views taken respectively along lines V-V and VI-VI on FIG. 4. The press-contacting portion 13*a* of each of the conductive contacts 13 is operative to come into press-contact with a corresponding one of connecting terminals provided on the FPC inserted in the housing 11 from the side of the upper plate-shaped portion 11*c* of the housing 11 so as to be electrically connected with the same, and the connecting terminal portion 13*b* of the conductive contact 13 is operative to be electrically connected with a signal terminal provided on the solid circuit board on which the housing 11 is mounted, for example, by means of soldering. Thereby, the connecting terminals provided on the FPC inserted in the housing 11 are electrically connected through the conductive contacts 13 with the signal terminals provided on the solid circuit board on which the housing 11 is mounted.

The electrical connector 10 has also a shell member 14 mounted on the housing 11 for covering an outer surface of the housing 11 except the front end portion 11*a* surrounding the opening 12, a major part of the rear end portion 11*b*, a part of each of left and right side end portions and a part of the upper plate-shaped portion 11*c*, a part of the upper plate-shaped portion 11*c* and a part of the lower plate-shaped portion 11*d* of the housing 11. That is, the shell member 14 is provided for covering partially the housing 11 and a major part of the upper plate-shaped portion 11*c*, a major part of the lower plate-shaped portion 11*d* and a major part of each of the left and right side end portions of the housing 11 is covered by the shell member 14.

The shell member 14 is formed by means of processing a resilient metal thin plate and grounded to be operative to contribute to adjustment on characteristic impedance of each of the conductive contacts 13 and to shield the conductive contacts 13 arranged on the housing 11 from electromagnetic wave noises coming from the outside.

Figure 8:
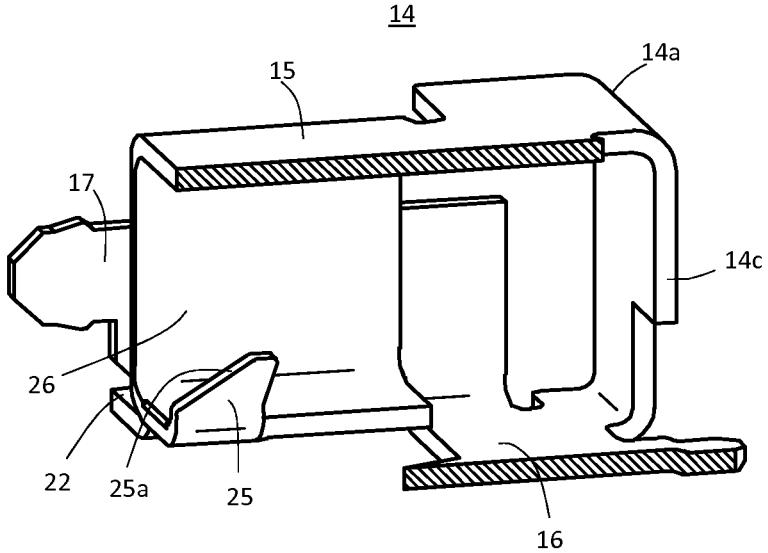
FIG. 8 is a schematic partial perspective view showing a part of the shell member shown in FIG. 7.
Figure 7:
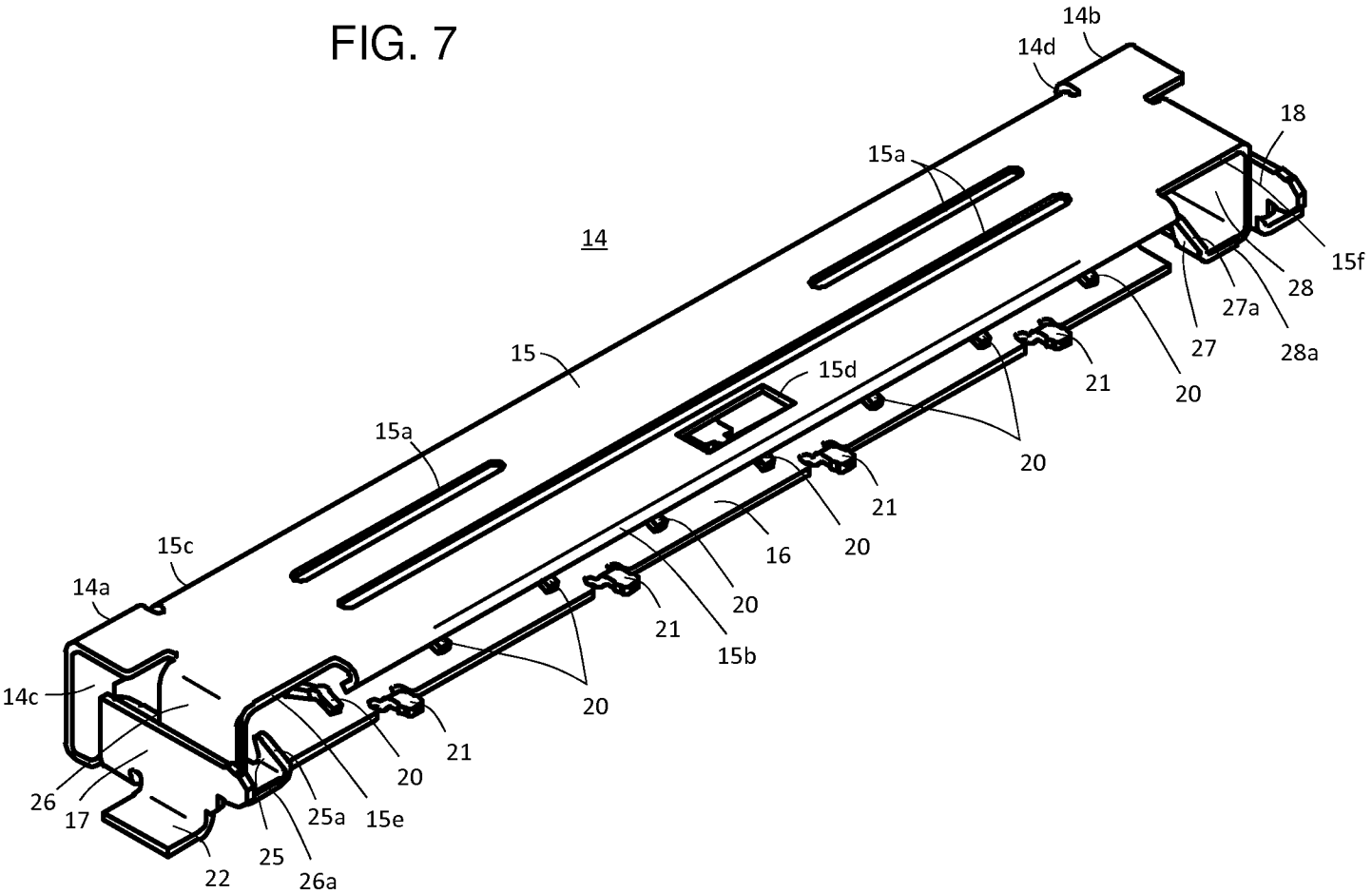
FIG. 7 is a schematic front, top and left side perspective view showing a shell member provided to be employed in the embodiment shown in each of FIGS. 1 and 2.

As shown in FIG. 7 which is a schematic front, top and left side perspective view showing the shell member 14 and FIG. 8 which is a schematic partial perspective view showing a part of the shell member 14, the shell member 14 is provided with an upper portion 15 for covering the major part of the upper plate-shaped portion 11*c* of the housing 11, a lower portion 16 for covering the part of the lower plate-shaped portion 11*d* of the housing 11, a left side portion 17 for facing the left side end portion of the housing 11, a right side portion 18 for facing the right side end portion of the housing 11, a front portion for forming a front opening and a rear portion for forming a rear opening.

The lower portion 16 of the shell member 14 is provided with a plurality of grounding contacts 20, each of which extends from a rear end portion of the lower portion 16 to be bent into an inside of the shell member 14 toward the front portion of the shell member 14, as shown also in FIG. 6.

Each of the grounding contacts 20 is operative to come into contact with a ground connecting portion provided on the FPC inserted in the housing 11 through the opening 12 provided thereon from the side of the lower portion 16 of the shell member 14. The lower portion 16 of the shell member 14 is further provided with a plurality of engaging portions 21 for engaging with the lower plate-shaped portion 11*d* of the housing 11.

The left side portion 17 and the right side portion 18 of the shell member 14 are provided respectively with board connecting portions 22 and 23. Each of the board connecting portions 22 and 23 is electrically connected with a grounded portion provided on the solid circuit board on which the housing 11 is mounted, for example, by means of soldering.

With the grounding contacts 20 and the board connecting portions 22 and 23 thus provided on the shell member 14, the ground connecting portion provided on the FPC inserted in the housing 11 is electrically connected through the shell member 14 with the grounded portion provided on the solid circuit board on which the housing 11 is mounted. Each of the board connecting portions 22 and 23 is operative to supply the shell member 14 with a ground potential from the solid circuit board and to be used for mounting the housing 11 on the solid circuit board.

As shown clearly in FIGS. 7 and 8, the shell member 14 is also provided with a holding portion 26 formed in a body therein. The holding portion 26 extends from a left end of the upper portion 15 of the shell member 14 covering the major part of the upper plate-shaped portion 11*c* of the housing 11, which is one of opposite ends of the upper portion 15 of the shell member 14 in a direction along which the conductive contacts 13 are arranged (hereinafter, referred to a contact arrangement direction), namely the longitudinal direction of the housing 11, to be bent toward the lower plate-shaped portion 11*d* of the housing 11 so as to reach into the housing 11 and is provided with an engaging projection 25 formed on a front side of a top end part thereof.

The engaging projection 25 is operative to be moved selectively for engaging with and disengaging from the FPC inserted in the housing 11.

The shell member 14 is further provided with a holding portion 28 formed in a body therein. The holding portion 28 extends from a right end of the upper portion 15 of the shell member 14 covering the major part of the upper plate-shaped portion 11*c* of the housing 11, which is the other of opposite ends of the upper portion 15 of the shell member 14 in the contact-arrangement direction (the longitudinal direction of the housing 11), to be bent toward the lower plate-shaped portion 11*d* of the housing 11 so as to reach into the housing 11 and is provided with an engaging projection 27 formed on a front side of a top end part thereof. The engaging projection 27 is operative to be moved selectively for engaging with and disengaging from the FPC inserted in the housing 11.

Each of the holding portions 26 and 28 is formed to constitute a resilient swingable portion. The holding portion 26 is operative to swing with a linear fulcrum placed at a root of the holding portion 26 connected with a rear end part 14*a* of the upper portion 15 of the shell member 14 in a direction intersecting the conductor-arrangement direction and the holding portion 28 is operative to swing with a linear fulcrum placed at a root of the holding portion 28 connected with a rear end part 14*b* of the upper portion 15 of the shell member 14 in the direction intersecting the conductor-arrangement direction.

The engaging projection 25 of the holding portion 26 is shaped to project from the top end part of the holding portion 26 toward the upper plate-shaped portion 11*c* of the housing 11 and provided with a slant surface 25*a* ascending in a direction from the front end portion 11*a* to the rear end portion 11*b* of the housing 11. Similarly, the engaging projection 27 of the holding portion 28 is shaped to project from the top end part of the holding portion 28 toward the upper plate-shaped portion 11*c* of the housing 11 and provided with a slant surface 27*a* ascending in a direction from the front end portion 11*a* to the rear end portion 11*b* of the housing 11.

When the FPC is inserted into the housing 11 through the opening 12 provided thereon, the holding portion 26 extending from the left end of the upper portion 15 of the shell member 14 causes the engaging projection 25 formed thereon to engage with an engaging portion provided on the FPC inserted in the housing 11 so that the holding portion 26 is put in engagement with the FPC for holding the same and similarly the holding portion 28 extending from the right end of the upper portion 15 of the shell member 14 causes the engaging projection 27 formed thereon to engage with another engaging portion provided on the FPC inserted in the housing 11 so that the holding portion 28 is put in engagement with the FPC for holding the same.

The upper portion 15 of the shell member 14 covering the major part of the upper plate-shaped portion 11*c* of the housing 11 constitutes a manipulatable releasing portion which is formed in a body in the shell member 14 to be manipulated for releasing each of the holding portions 26 and 28 from the engagement with the FPC inserted in the housing 11. Hereinafter, the upper portion 15 of the shell member 14 is referred to the manipulatable releasing portion 15, as occasion demands.

The manipulatable releasing portion 15 is formed also to constitute a resilient swingable portion. The manipulatable releasing portion 15 is operative to swing with a linear fulcrum placed at a root of the manipulatable releasing portion 15 connected with each of the rear end parts 14*a* and 14*b* of the upper portion 15 of the shell member 14 in a direction intersecting the conductor-arrangement direction. When the manipulatable releasing portion 15 is manipulated for releasing each of the holding portions 26 and 28 from the engagement with the FPC inserted in the housing 11, a manipulation with pressure toward the housing 11 is inflicted on a front edge of the manipulatable releasing portion 15 and thereby the manipulatable releasing portion 15 is caused to swing for shifting its position to approach to the lower plate-shaped portion 11*d* of the housing 11.

The manipulatable releasing portion 15 is provided with a plurality of grooves 15*a* each extending in the contact-arrangement direction. With the grooves 15*a* thus provided, the manipulatable releasing portion 15 is reinforced and made easy to be manipulated. A single groove can be provided on the manipulatable releasing portion 15 in place of the grooves 15*a*. Further, a single or a plurality of protuberances can be provided also on the manipulatable releasing portion 15 in place of the grooves 15*a* and the manipulatable releasing portion 15 is reinforced and made easy to be manipulated with the protuberance or protuberances.

Figure 12:
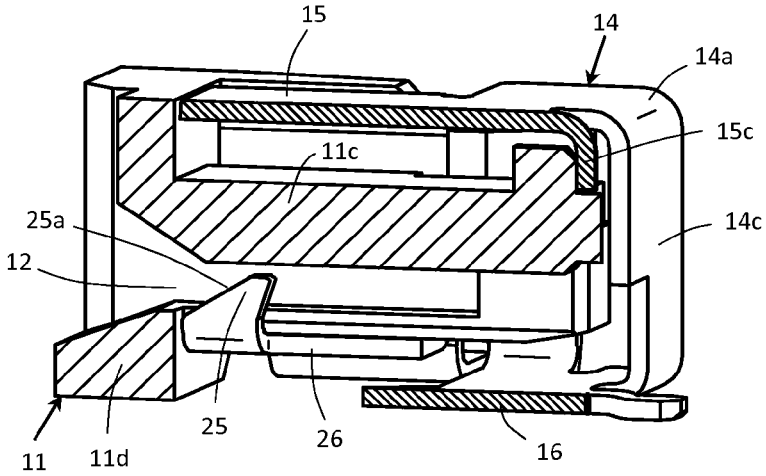
FIG. 12 is a schematic partial perspective view including partial cross sections and used for explaining a positional relation between the housing and a holding portion employed in the embodiment shown in each of FIGS. 1 and 2.
Figure 14:
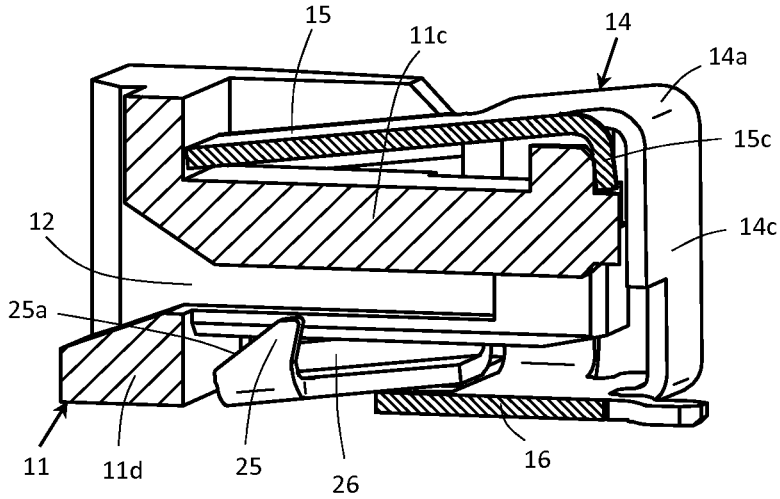
FIG. 14 is a schematic partial perspective view including partial cross sections and used for explaining a positional relation between the housing and the manipulatable releasing portion employed in the embodiment shown in each of FIGS. 1 and 2.

The manipulatable releasing portion 15 is provided further with a bent portion 15*b* extending to be bent from a front edge thereof toward the lower plate-shaped portion 11*d* of the housing 11 in the contact-arrangement direction and an engaging bent portion 15*c* extending to be bent from the rear edge thereof toward the lower plate-shaped portion 11*d* of the housing 11 in the contact-arrangement direction. The bent portion 15*b* of the manipulatable releasing portion 15 is operative to shut a predetermined space formed between the upper plate-shaped portion 11*c* of the housing 11 and the manipulatable releasing portion 15 (the upper portion 15 of the shell member 14). The engaging bent portion 15*c* of the manipulatable releasing portion 15 is operative to engage with a part of the rear end portion 11*b* of the housing 11, as shown in FIGS. 12 and 14.

With the bent portion 15*b* provided for shutting the space formed between the upper plate-shaped portion 11*c* of the housing 11 and the manipulatable releasing portion 15 (the upper portion 15 of the shell member 14), it is avoided that the FPC is not inserted into the opening 12 provided on the housing 11 but inserted wrongly into the space formed between the housing 11 and the shell member 14. Further, with the engaging bent portion 15*c* provided for engaging with the part of the rear end portion 11*b* of the housing 11, the manipulation on the manipulatable releasing portion 15 for moving the front edge of the manipulatable releasing portion 15 to approach to the housing 11 can be easily carried out and the manipulatable releasing portion 15 is prevented from being deformed by the manipulation thereon.

In addition, the manipulatable releasing portion 15 is provided with an engaging opening 15*d* for engaging with a projection 11*e* formed on the upper plate-shaped portion 11*c* of the housing 11, as shown in FIGS. 2 and 3. When the manipulatable releasing portion 15 is manipulated so that the front edge of the manipulatable releasing portion 15 is moved to approach to the housing 11, the projection 11*e* formed on the upper plate-shaped portion 11*c* of the housing 11 is operative to project through the engaging opening 15*d* provided on the manipulatable releasing portion 15 and, with the projection 11*e* thus projecting through the engaging opening 15*d*, it can be easily detected that the manipulatable releasing portion 15 is put in the manipulation for causing the front edge thereof to approach to the housing 11.

The shell member 14 is provided on opposite end portions thereof in the contact-arrangement direction respectively with connecting portions 14*c* and 14*d* for connecting the upper portion 15 covering the major part of the upper plate-shaped portion 11*c* of the housing 11 with the lower portion 16 provided to be close to the lower plate-shaped portion 11*d* of the housing 11 at the side of the rear end portion 11*b* of the housing 11. Each of the connecting portions 14*c* and 14*d* provided on the shell member 14 is subjected to resilient deformation responding to swinging movements of the manipulatable releasing portion 15. With the connecting portions 14*c* and 14*d* provided on the shell member 14 for operating thus, the manipulatable releasing portion 15 can be easily deformed resiliently with the manipulation thereon for causing the front edge thereof to approach to the housing 11.

Figure 9:
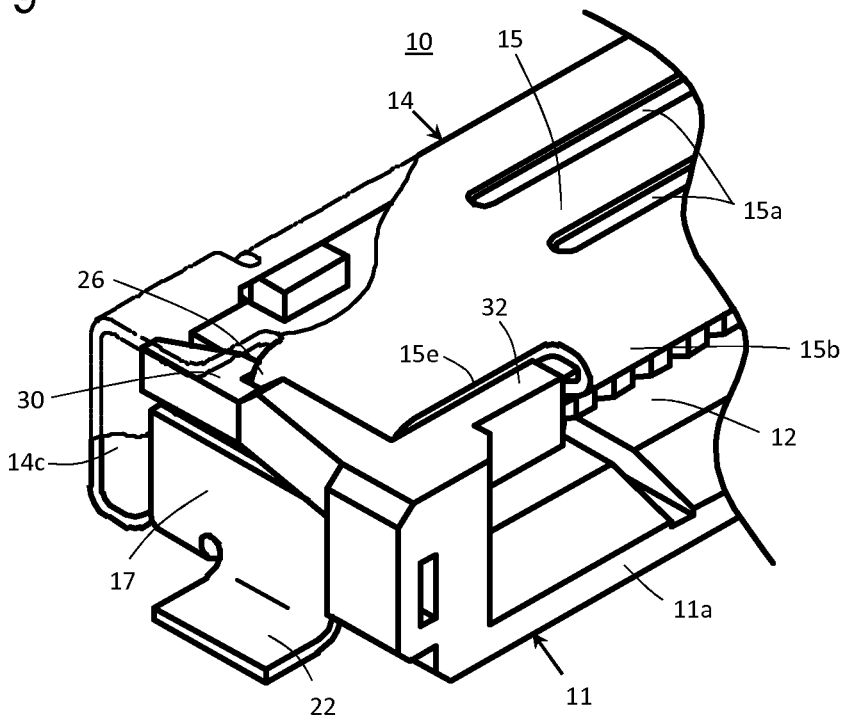
FIG. 9 is a schematic partial perspective view showing a part of the embodiment shown in each of FIGS. 1 and 2, wherein a portion has been cut away.
Figure 10:
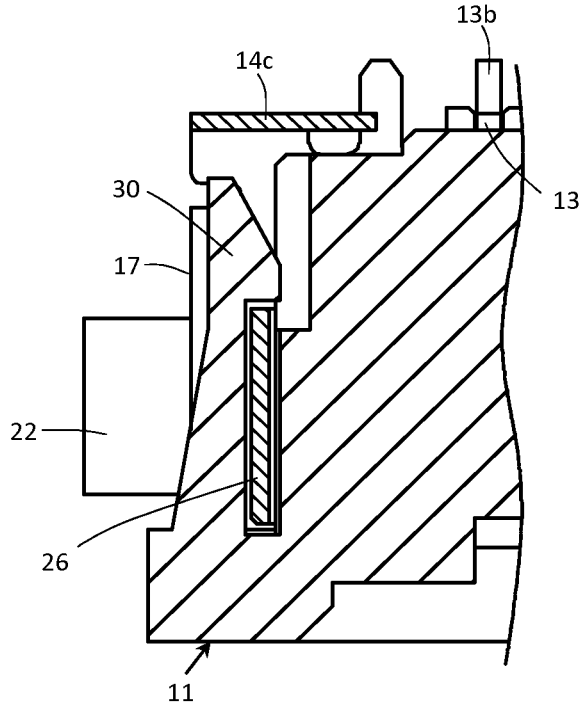
FIG. 10 is a schematic partial cross sectional view showing a part of the embodiment shown in each of FIGS. 1 and 2.

In the electrical connector 10 comprising the housing 11 and the shell member 14 mounted on the housing 11, as shown clearly in FIGS. 9 and 10, the housing 11 is provided on the left side end portion thereof with a claw-shaped holding portion 30 for engaging with the left end of the upper portion 15 of the shell member 14 in which the holding portion 26 is formed so as to hold the shell member 14 and provided also on the right side end portion thereof with a claw-shaped holding portion 31 for engaging with the right end of the upper portion 15 of the shell member 14 in which the holding portion 28 is formed so as to hold the shell member 14. With the claw-shaped holding portions 30 and 31 thus provided for holding the shell member 14, the shell member 14 is prevented from shifting its position undesirably in regard to the housing 11 when the manipulatable releasing portion 15 is manipulated with the pressure directed toward the housing 11, for example.

Further, as shown in FIG. 7, carrier-cut portions 15*e* and 15*f*, each of which is a portion cut away from a frame of a framed product obtained by means of press-processing a resilient metal thin plate, appear as end face portions respectively on front sides of the left and right ends of the upper portion 15 of the shell member 14 and the housing 11 is provided with cover-portions 32 and 33 for covering the carrier-cut portions, respectively. With the cover-portions 32 and 33 of the housing 11 provided for covering the carrier-cut portions, it is avoided that an operator who manipulates the manipulatable releasing portion 15 is wounded by the end face portion of the shell member 14 which is the carrier-cut portions 15*e* or the carrier-cut portions 15*f*.

Figure 11:
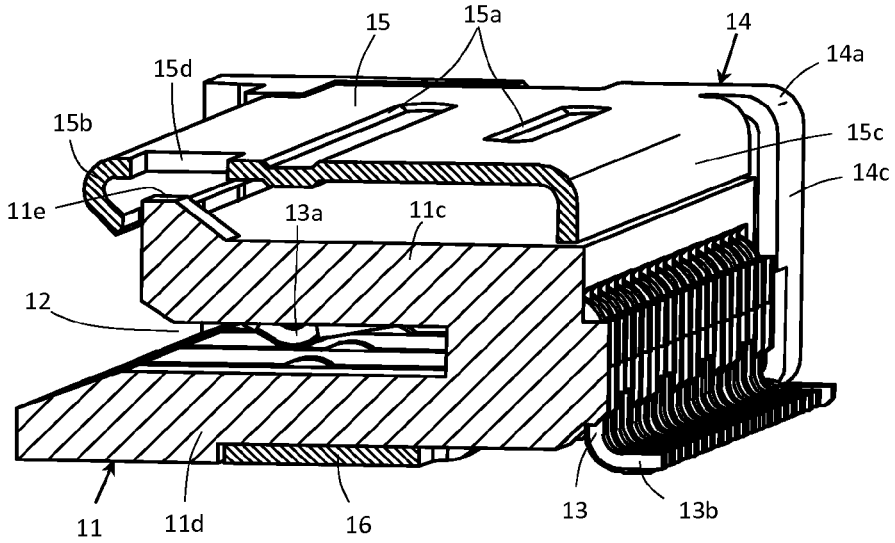
FIG. 11 is a schematic partial perspective view including partial cross sections and used for explaining a positional relation between a housing and a manipulatable releasing portion employed in the embodiment shown in each of FIGS. 1 and 2.

Under a situation as mentioned above, when the manipulatable releasing portion 15 is not subjected to the manipulation for releasing the holding portions 26 and 28 from the engagement with the FPC inserted in the housing 11, the manipulatable releasing portion 15 is positioned to form the space between the upper plate-shaped portion 11*c* of the housing 11 and the manipulatable releasing portion 15 and to cover the major part of the upper plate-shaped portion 11*c* of the housing 11, as shown in FIGS. 11 and 12. The bent portion 15*b* extending to be bent from the front edge of the manipulatable releasing portion 15 shuts the space formed between the upper plate-shaped portion 11*c* of the housing 11 and the manipulatable releasing portion 15 and the engaging opening 15*d* provided on the manipulatable releasing portion 15 is positioned to face the projection 11*e* formed on the upper plate-shaped portion 11*c* of the housing 11.

On that occasion, the engaging projection 25 of the holding portion 26 having the slant surface 25*a* formed hereon is positioned in the inside of the opening 12 provided on the housing 11, as shown in FIG. 12, and although an illustrative explanation is omitted, the engaging projection 27 of the holding portion 28 having the slant surface 27*a* formed hereon is also positioned in the inside of the opening 12 provided on the housing 11.

At that time, the manipulatable releasing portion 15 is put in a condition wherein the manipulatable releasing portion 15 is able to swing with the linear fulcrum placed at the root of the manipulatable releasing portion 15 connected with each of the rear end parts 14*a* and 14*b* of the upper portion 15 of the shell member 14 for shifting its position so that the front edge thereof from which the bent portion 15*b* extends is moved downward to approach to the lower plate-shaped portion 11*d* of the housing 11 when the manipulation with the pressure toward the housing 11 is inflicted on the front edge of the manipulatable releasing portion 15. The holding portion 26 is put in a condition to be able to swing with the linear fulcrum placed at the root of the holding portion 26 connected with the rear end part 14*a* of the upper portion 15 of the shell member 14 in response to the swinging movement of the manipulatable releasing portion 15 and similarly the holding portion 28 is put in a condition to be able to swing with the linear fulcrum placed at the root of the holding portion 28 connected with the rear end part 14*b* of the upper portion 15 of the shell member 14 in response to the swinging movement of the manipulatable releasing portion 15.

When the FPC is inserted into the housing 11 through the opening 12 provided thereon under a condition wherein the engaging projection 25 of the holding portion 26 having the slant surface 25*a* formed hereon and the engaging projection 27 of the holding portion 28 having the slant surface 27*a* formed hereon are positioned in the inside of the opening 12 provided on the housing 11, each of the engaging projection 25 of the holding portion 26 and the engaging projection 27 of the holding portion 28 engages with the engaging portion provided on the FPC inserted in the housing 11 so that the FPC is held by the holding portions 26 and 28.

On the way to a condition wherein the FPC is completely inserted in the housing 11 through the opening 12 provided thereon, the FPC comes into contact with the slant surface 25*a* formed on the engaging projection 25 of the holding portion 26 and the slant surface 27*a* formed on the engaging projection 27 of the holding portion 28 to push the same downward so that each of the engaging projection 25 of the holding portion 26 and the engaging projection 27 of the holding portion 28 is moved to go away from the inside of the opening 12 provided on the housing 11. As a result, the FPC inserted continuously into the housing 11 is not disturbed by the engaging projection 25 of the holding portion 26 and the engaging projection 27 of the holding portion 28.

Figure 13:
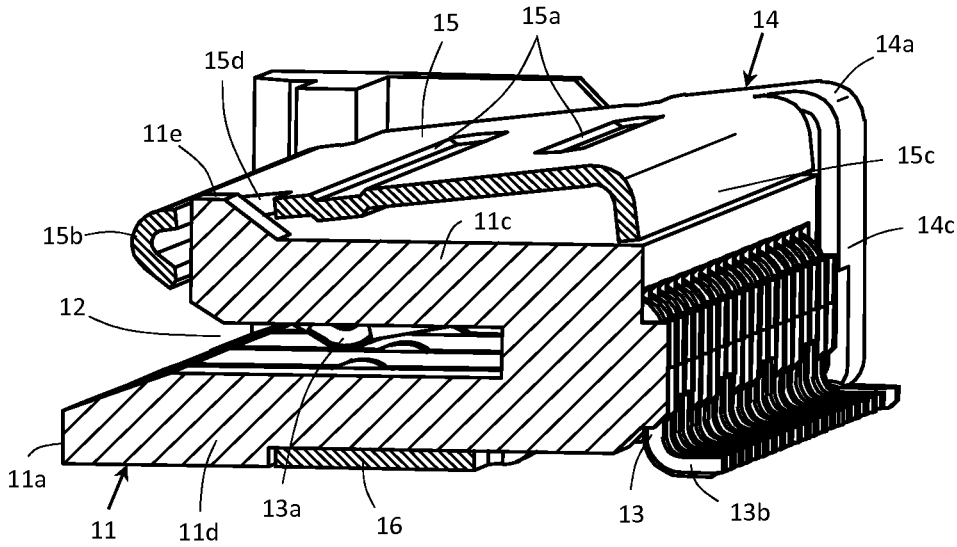
FIG. 13 is a schematic partial perspective view including partial cross sections and used for explaining a positional relation between the housing and the manipulatable releasing portion employed in the embodiment shown in each of FIGS. 1 and 2.

Then, when the manipulation with the pressure toward the housing 11 is inflicted on the front edge of the manipulatable releasing portion 15 for releasing the holding portions 26 and 28 from the engagement with the FPC for holding the same, the manipulatable releasing portion 15 swings with the linear fulcrum placed at the root of the manipulatable releasing portion 15 connected with each of the rear end parts 14*a* and 14*b* of the upper portion 15 of the shell member 14 for shifting its position so that the front edge thereof from which the bent portion 15*b* extends is moved downward to approach to the lower plate-shaped portion 11*d* of the housing 11, as shown in FIGS. 13 and 14.

On that occasion, the projection 11*e* formed on the upper plate-shaped portion 11*c* of the housing 11 projects upward through the engaging opening 15*d* provided on the manipulatable releasing portion 15 and thereby it can be easily detected that the manipulatable releasing portion 15 is put in the manipulation for releasing the holding portions 26 and 28 from the engagement with the FPC for holding the same.

With such a movement of the manipulatable releasing portion 15, the holding portion 26 swings with the linear fulcrum placed at the root of the holding portion 26 connected with the rear end part 14*a* of the upper portion 15 of the shell member 14 so that the engaging projection 25 of the holding portion 26 having the slant surface 25*a* formed hereon is moved to go away from the inside of the opening 12 provided on the housing 11, as shown in FIG. 14, and although an illustrative explanation is omitted, the holding portion 28 swings with the linear fulcrum placed at the root of the holding portion 28 connected with the rear end part 14*b* of the upper portion 15 of the shell member 14 so that the engaging projection 27 of the holding portion 28 having the slant surface 27*a* formed hereon is moved to go away from the inside of the opening 12 provided on the housing 11.

As a result, in the case where the holding portions 26 and 28 are put in the engagement with the FPC for holding the same when the manipulation with the pressure toward the housing 11 is inflicted on the front edge of the manipulatable releasing portion 15, the holding portions 26 and 28 are released from the engagement with the FPC for holding the same so that the FPC is put in a condition to be able to get out of the housing 11.

Figure 15:
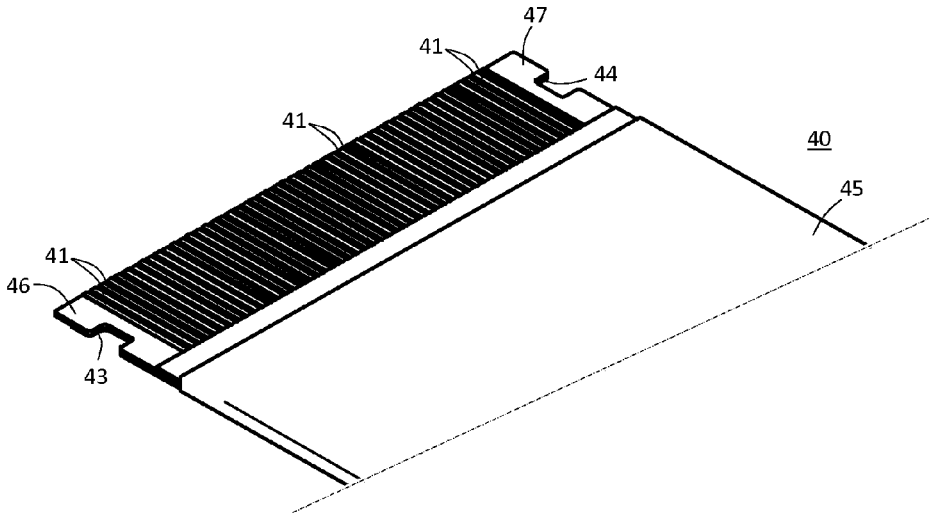
FIG. 15 is a schematic partial perspective view showing a part of an FPC which is to be inserted into the housing of the embodiment shown in each of FIGS. 1 and 2.
Figure 16:
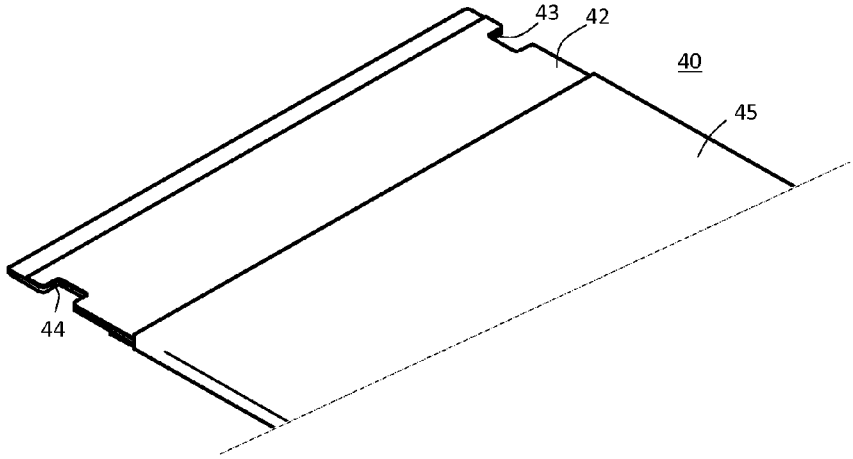
FIG. 16 is a schematic partial perspective view showing a part of an FPC which is to be inserted into the housing of the embodiment shown in each of FIGS. 1 and 2.

FIGS. 15 and 16 show an FPC 40 which is an example of the FPC constituting the flat circuit device to be inserted into the housing 11 of the electrical connector 10 through the opening 12 provided on the housing 11.

Referring to FIGS. 15 and 16, a plurality of connecting terminals 41 each made of conductive material and formed into a rectangular plate member are provided on a first surface opposite to a second surface of the FPC 40 to be arranged at an end portion of the first surface, as shown in FIG. 15, and a ground connecting portion 42 in the shape of a plate is also provided on the second surface of the FPC 40, as shown in FIG. 16. Further, a pair of engaging edged recesses and 44 each constituting an engaging portion are provided respectively on side end portions of the FPC 40 which are opposite each other with the connecting terminals 41 between. A top flat portion 46 is formed at the outside of the engaging edged recess 43 provided on one of the side end portions of the FPC 40 and another top flat portion 47 is formed at the outside of the engaging edged recess 44 provided on the other of the side end portions of the FPC 40.

It is possible to provide the FPC 40 with a pair of engaging edged holes as engaging portions in place of the engaging edged recesses 43 and 44. The FPC 40 is wrapped with a covering film 45 except a portion thereof on which the connecting terminals 41, the ground connecting portion 42, the engaging edged recesses 43 and 44 and the top flat portions 46 and 47 are provided.

Figure 17:
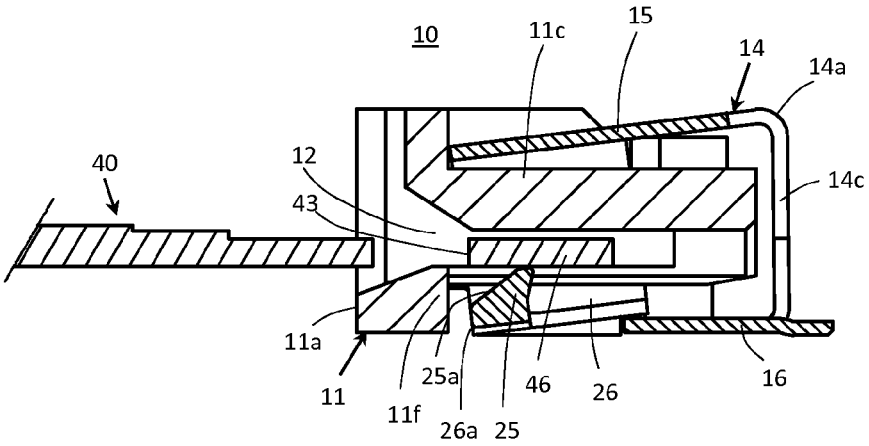
FIG. 17 is a schematic partial cross sectional view showing a situation wherein the FPC is on the way to complete insertion into the embodiment shown in each of FIGS. 1 and 2.

FIG. 17 shows the electrical connector 10 and the FPC 40 shown in FIGS. 15 and 16 which is on the way to complete insertion into the housing 11 of the electrical connector 10 through the opening 12 provided on the housing 11. In FIG. 17, the first surface of the FPC 40, on which the connecting terminals 41 are provided, faces upward to appear on the side of the manipulatable releasing portion 15 formed in the shell member 14, and the second surface of the FPC 40, on which the ground connecting portion 42 is provided, faces downward to appear on the side of the lower portion 16 of the shell member 14. A top end of a part of the FPC 40 on which the connecting terminals 41 are provided is postured to be parallel with the rear end portion 11*b* of the housing 11 in a condition wherein the FPC 40 is properly inserted into the housing 11 through the opening 12 provided thereon.

The FPC 40 is inserted into the housing 11 of the electrical connector 10 through the opening 12 provided on the housing 11 under a condition wherein the manipulation with the pressure toward the housing 11 is not inflicted on the front edge of the manipulatable releasing portion 15 formed in the shell member 14, the engaging projection 25 of the holding portion 26 having the slant surface 25*a* formed thereon is positioned in the inside of the opening 12 provided on the housing 11, as shown in FIG. 12, and the engaging projection 27 of the holding portion 28 having the slant surface 27*a* formed thereon is positioned in the inside of the opening 12 provided on the housing 11.

When the FPC 40 is inserted into the housing 11 through the opening 12 provided thereon with the top end thereof facing the rear end portion 11*b* of the housing 11 and the first surface of the FPC 40 facing upward, the top flat portion 46 formed at the outside of the engaging edged recess 43 of the FPC 40 comes into contact having the slant surface 25*a* formed on the engaging projection 25 of the holding portion 26 to push the same downward so that the holding portion 26 swings with the linear fulcrum placed at the root of the holding portion 26 connected with the rear end part 14*a* of the upper portion 15 of the shell member 14 for moving the engaging projection 25 of the holding portion 26 having the slant surface 25*a* formed hereon to go away from the inside of the opening 12 provided on the housing 11, as shown in FIG. 17. Further, although an illustrative explanation is omitted, the top flat portion 47 formed at the outside of the engaging edged recess 44 of the FPC 40 comes into contact with the slant surface 27*a* formed on the engaging projection 27 of the holding portion 28 to push the same downward so that the holding portion 28 swings with the linear fulcrum placed at the root of the holding portion 28 connected with the rear end part 14*b* of the upper portion 15 of the shell member 14 for moving the engaging projection 27 of the holding portion 28 having the slant surface 27*a* formed hereon to go away from the inside of the opening 12 provided on the housing 11.

After that, the FPC 40 is further inserted into the housing 11 to reach a predetermined appropriate position in the housing 11. When the FPC 40 has reached the predetermined appropriate position in the housing 11, the insertion of the FPC 40 into the housing 11 is completed.

Figure 18:
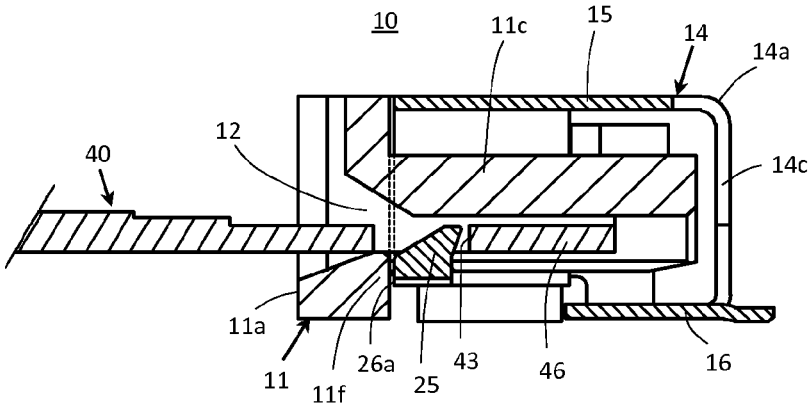
FIG. 18 is a schematic partial cross sectional view showing a situation wherein the FPC has been correctly inserted into the embodiment shown in each of FIGS. 1 and 2 to be held by the holding portion employed in the embodiment shown in each of FIGS. 1 and 2.

When the FPC 40 is completely inserted into the housing 11, the engaging projection 25 of the holding portion 26 gets out of the contact with the top flat portion 46 of the FPC 40 and thereby engages with the engaging edged recess 43 provided on the FPC 40, as shown in FIG. 18. Further, although an illustrational explanation is omitted, the engaging projection 27 of the holding portion 28 also gets out of the contact with the top flat portion 47 of the FPC 40 and thereby engages with the engaging edged recess 44 provided on the FPC 40.

On that occasion, the holding portion 26 is caused by its own restoring resiliency to swing with the linear fulcrum placed at the root of the holding portion 26 connected with the rear end part 14*a* of the upper portion 15 of the shell member 14 to be restored for moving the engaging projection 25 of the holding portion 26 having the slant surface 25*a* formed hereon to be positioned in the inside of the opening 12 provided on the housing 11 so that the engaging projection 25 engages with the engaging edged recess 43 provided on the FPC 40. As a result, the holding portion 26 is put in the engagement with the FPC 40 inserted in the housing 11 for holding the same.

Similarly, the holding portion 28 is caused by its own restoring resiliency to swing with the linear fulcrum placed at the root of the holding portion 28 connected with the rear end part 14*b* of the upper portion 15 of the shell member 14 to be restored for moving the engaging projection 27 of the holding portion 28 having the slant surface 27*a* formed hereon to be positioned in the inside of the opening 12 provided on the housing 11 so that the engaging projection 27 engages with the engaging edged recess 44 provided on the FPC 40. As a result, the holding portion 28 is put in the engagement with the FPC 40 inserted in the housing 11 for holding the same.

Under a condition wherein the FPC 40 inserted in the housing 11 through the opening 12 provided thereon takes up the predetermined appropriate position in the housing 11 so as to be held by each of the holding portions 26 and 28 in such a manner as described above, as shown in FIG. 18, a front end portion 26*a* of the holding portion 26 is positioned to come into contact with or close to an inside part 11*f* of the front end portion 11*a* of the housing 11 on which the opening 12 opens, and a front end portion 28*a* (FIG. 7) of the holding portion 28 is positioned to come into contact with or close to the inside part 11*f* of the front end portion 11*a* of the housing 11 on which the opening 12 opens. Accordingly, when an undesirable force is exerted on the FPC 40 inserted in the housing 11 and held by the holding portions 26 and 28 to pull the same out of the housing 11, the front end portion 26*a* of the holding portion 26 and the front end portion 28*a* of the holding portion 28 are restricted by the front end portion 11*a* of the housing 11 so that each of the holding portions 26 and 28 is prevented from shifting undesirably its position and therefore it is avoided that the FPC 40 gets out of the housing 11.

When the engaging projection 25 of the holding portion 26 engages with the engaging edged recess 43 provided on the FPC 40 and the engaging projection 27 of the holding portion 28 engages with the engaging edged recess 44 provided on the FPC 40 so that the FPC 40 is held by the holding portions 26 and 28 to be prevented from getting out of the housing 11 unwillingly, as shown in FIG. 18, the holding portion 26 swings with the linear fulcrum placed at the root of the holding portion 26 connected with the rear end part 14*a* of the upper portion 15 of the shell member 14 and the engaging projection 25 formed on the front side of the top end part the holding portion 26 engages with the engaging edged recess 43 provided on the FPC 40 from the side of the lower portion 16 of the shell member 14 and similarly the holding portion 28 swings with the linear fulcrum placed at the root of the holding portion 28 connected with the rear end part 14*b* of the upper portion 15 of the shell member 14 and the engaging projection 27 formed on the front side of the top end part the holding portion 28 engages with the engaging edged recess 44 provided on the FPC 40 from the side of the lower portion 16 of the shell member 14. Accordingly, when an undesirable force is exerted on the FPC 40 inserted in the housing 11 and held by the holding portions 26 and 28 to pull the same out of the housing 11, each of the engaging projection 25 of the holding portion 26 and the engaging projection 27 of the holding portion 28 is shifted in its position upward, namely in the direction from the lower plate-shaped portion 11*d* to the upper plate-shaped portion 11*c* of the housing 11, so as to strengthen the engagement with the engaging edged recess 43 or the engaging edged recess 44 provided on the FPC 40.

Under a condition wherein the FPC 40 inserted in the housing 11 through the opening 12 provided is held by the holding portions 26 and 28 to be prevented from getting out of the housing 11 unwillingly, as described above, the press-contacting portion 13*a* of each of the conductive contacts 13 arranged on the housing 11 comes into press-contact with a corresponding one of the connecting terminals 41 provided on the FPC 40, which is inserted in the housing 11 with the first surface thereof provided thereon with the connecting terminals 41 facing upward, from the side of the upper portion 15 of the shell member 14. As a result, the connecting terminals 41 provided on the FPC 40 inserted in the housing 11 are electrically connected through the conductive contacts 13 with the signal terminals provided on the solid circuit board on which the housing 11 is mounted.

Further, each of the grounding contacts 20 extending from the lower portion 16 of the shell member 14 to be bent into the inside of the opening 12 provided on the housing 11 comes into contact with the ground connecting portion 42 provided on the second surface of the FPC 40 inserted in the housing 11 from the side of the lower portion 16 of the shell member 14. As a result, the ground connecting portion 42 provided on the FPC 40 inserted in the housing 11 is electrically connected through the grounding contacts 20 with the grounded portion provided on the solid circuit board on which the housing 11 is mounted.

After that, when the manipulatable releasing portion 15 is manipulated with the pressure directed toward the housing 11 and inflicted on the front edge thereof for releasing the holding portions 26 and 28 from the engagement with the FPC 40 for holding the same, the manipulatable releasing portion 15 swings with the fulcrum placed at the root of the manipulatable releasing portion 15 connected with each of the rear end parts 14*a* and 14*b* of the upper portion 15 of the shell member 14 for shifting its position so that the front edge thereof from which the bent portion 15*b* extends is moved downward to approach to the lower plate-shaped portion 11*d* of the housing 11.

With the movement of the manipulatable releasing portion 15 thus carried out, the holding portion 26 swings with the linear fulcrum placed at the root of the holding portion 26 connected with the rear end part 14*a* of the upper portion 15 of the shell member 14 so that the engaging projection 25 of the holding portion 26 having the slant surface 25*a* formed hereon is moved to go away from the inside of the opening 12 provided on the housing 11 and the holding portion 28 swings with the linear fulcrum placed at the root of the holding portion 28 connected with the rear end part 14*b* of the upper portion 15 of the shell member 14 so that the engaging projection 27 of the holding portion 26 having the slant surface 27*a* formed hereon is moved to go away from the inside of the opening 12 provided on the housing 11. As a result, the engaging projection 25 of the holding portion 26 and the engaging projection 27 of the holding portion 28 disengage respectively from the engaging edged recesses 43 and 44 provided on the FPC 40 and thereby the holding portions 26 and 28 are released from the engagement with the FPC 40 for holding the same so that the FPC 40 is put in a condition to be able to get out of the housing 11.

Then, when the manipulatable releasing portion 15 is released from the manipulation with the pressure directed toward the housing 11, the manipulatable releasing portion 15 swings with the fulcrum placed at the root of the manipulatable releasing portion 15 connected with each of the rear end parts 14*a* and 14*b* of the upper portion 15 of the shell member 14 to be restored to its condition prior to the manipulation inflicted thereon by means of its own restoring resiliency. With such a restoring movement of the manipulatable releasing portion 15, the holding portion 26 swings with the fulcrum placed at the root of the holding portion 26 connected with the rear end part 14*a* of the upper portion 15 of the shell member 14 to be restored to its condition prior to the manipulation inflicted on the manipulatable releasing portion 15 by means of its own restoring resiliency and similarly the holding portion 28 swings with the fulcrum placed at the root of the holding portion 28 connected with the rear end part 14*b* of the upper portion 15 of the shell member 14 to be restored to its condition prior to the manipulation inflicted on the manipulatable releasing portion 15 by means of its own restoring resiliency.

In the electrical connector 10 thus constituted as the embodiment of electrical connector according to the present invention, as described above, when the FPC 40 is inserted into the housing 11 through the opening 12 provided thereon, the press-contacting portion 13*a* of each of the conductive contacts 13 arranged on the housing 11 comes into contact with the corresponding one of the connecting terminals 41 provided on the FPC 40 inserted in the housing 11 and the engaging projection 25 of the holding portion 26 and the engaging projection 27 of the holding portion 28 formed in a body in the shell member 14 engage respectively with the engaging edged recesses 43 and 44 provided on the FPC 40 so that each of the holding portions 26 and 28 is put in the engagement with the FPC 40 inserted in the housing 11 for holding the same. As a result, the FPC 40 inserted in the housing 11 is held by the holding portions 26 and 28 so as to be surely prevented from getting out of the housing 11 unwillingly and the conductive contacts 13 arranged on the housing 11 are stably kept in electrical connection with the connecting terminals 41 provided on the FPC 40 inserted in the housing 11.

Then, when the manipulatable releasing portion 15, which is also formed in a body in the shell member 14 in addition to the holding portions 26 and 28, is manipulated to release each of the holding portions 26 and 28 from the engagement with the FPC 40 inserted in the housing 11 under the condition wherein the FPC 40 inserted in the housing 11 is put in the holding by each of the holding portions 26 and 28, the manipulatable releasing portion 15 is moved to shift the holding portions 26 and 28 so that each of the holding portions 26 and 28 is released from the engagement with the FPC 40 inserted in the housing 11. As a result, the FPC 40 inserted in the housing 11 is released from the holding by each of the holding portions 26 and 28 so as to be able to get out of the housing 11.

Accordingly, with the electrical connector 10, the FPC 40 inserted in the housing 11 can be put in the holding by the holding portions 26 and 28 formed in a body in the shell member 14 to be surely prevented from getting out of the housing 11 unwillingly and then released from the holding by the holding portions 26 and 28 to be able to get out of the housing 11 with an improved structure with which the electrical connector 10 can be miniaturized on the whole and the number of structural parts can be reduced.

Further, in the electrical connector 10 constituted as described above, since the manipulatable releasing portion 15, which is constituted with the upper portion 15 of the shell member 14 covering the upper plate-shaped portion 11*c* of the housing 11, is manipulated with the pressure directed toward the housing 11 to swing with the fulcrum placed at the root of the manipulatable releasing portion 15 connected with each of the rear end parts 14*a* and 14*b* of the upper portion 15 of the shell member 14 for releasing the holding portions 26 and 28 from the engagement with the FPC 40, the FPC 40 inserted in the housing 11 can be surely released from the holding by the holding portions 26 and 28 by means of a quite simple and easy manipulation inflicted on the manipulatable releasing portion 15 of the shell member 14.

Incidentally, although the FPC 40 is inserted in the housing 11 with the first surface thereof provided thereon with the connecting terminals 41 and facing upward under a condition wherein the press-contacting portion 13*a* of each of the conductive contacts 13, which is provided for coming into press-contact with the connecting terminal 41 provided on the first surface of the FPC 40, is arranged to project into the inside of the opening 12 provided on the housing 11 from the side of the upper portion 15 of the shell member 14, in the electrical connector 10 described above, it is also possible to modify the electrical connector 10 in such a manner that the FPC 40 is inserted in the housing 11 with the first surface thereof provided thereon with the connecting terminals 41 and facing downward under a condition wherein the press-contacting portion 13*a* of each of the conductive contacts 13, which is provided for coming into press-contact with the connecting terminal 41 on the first surface of the FPC 40, is arranged to project into the inside of the opening 12 provided on the housing 11 from the side of the lower portion 16 of the shell member 14.

The invention claimed is:

1. An electrical connector comprising:

a housing made of insulator and provided thereon with an opening through which a flat circuit device is inserted into the housing and which opens on a first end portion of the housing, a plurality of conductive contacts arranged on the housing, each of which has a connecting terminal portion projecting from a second end portion opposite to the first end portion of the housing to the outside of the housing and a press-contacting portion positioned in the housing to be operative to come into press-contact with a connecting terminal provided on the flat circuit device inserted in the housing through the opening provided thereon, and a shell member mounted on the housing for covering partially the same and provided in a body therein with a holding portion operative to be put in engagement with the flat circuit device inserted in the housing for holding the same and a manipulatable releasing portion formed to be manipulated for releasing the holding portion from the engagement with the flat circuit device inserted in the housing, wherein the holding portion is constituted to extend to be bent from an end of a portion of the shell member provided for covering a first plate-shaped portion of the housing toward a second plate-shaped portion opposite to the first plate-shaped portion of the housing so as to reach into an inside of the housing and to have an engaging projection formed thereon to be moved selectively for engaging with and disengaging from the flat circuit device inserted in the housing, and the manipulatable releasing portion is constituted with the portion of the shell member provided for covering the first plate-shaped portion of the housing to be operative to shift its position with the holding portion in a direction intersecting a direction along which the conductive contacts are arranged;

wherein the holding portion is operative to swing with a linear fulcrum placed at a portion of the shell member close to the second end portion of the housing and the manipulatable releasing portion is operative to swing with a linear fulcrum placed at the second portion of the shell member close to the second end portion of the housing.

2. An electrical connector according to claim 1, wherein each of the holding portion and the manipulatable releasing portion constitutes a resilient swingable portion.

3. An electrical connector according to claim 1, wherein the engaging projection is formed on an end of the holding portion on the side of the opening provided on the housing.

4. An electrical connector according to claim 1, wherein the engaging projection formed on the holding portion is shaped to project from the holding portion in a direction to the first plate-shaped portion of the housing from the second plate-shaped portion of the housing.

5. An electrical connector according to claim 4, wherein the engaging projection shaped to project from the holding portion is provided with a slant surface ascending in a direction from the first end portion to the second end portion of the housing.

6. An electrical connector according to claim 1, wherein the engaging projection formed on the holding portion is provided with an end portion thereof on the side of the first end portion of the housing positioned to come into contact with the first end portion of the housing.

7. An electrical connector according to claim 1, wherein the engaging projection formed on the holding portion is provided with an end portion thereof on the side of the first end portion of the housing positioned close to the first end portion of the housing.

8. An electrical connector according to claim 1, wherein the manipulatable releasing portion is provided with at least one groove extending in the direction along which the conductive contacts are arranged.

9. An electrical connector according to claim 1, wherein the manipulatable releasing portion is provided with at least one protuberance extending in the direction along which the conductive contacts are arranged.

10. An electrical connector according to claim 1, wherein the manipulatable releasing portion is provided with a bent portion extending to be bent from an edge thereof on the side of the opening provided on the housing toward the second plate-shaped portion of the housing for shutting a space between the first plate-shaped portion of the housing and the portion of the shell member provided for covering the first plate-shaped portion of the housing.

11. An electrical connector according to claim 1, wherein the manipulatable releasing portion is provided with an engaging bent portion extending to be bent from an edge thereof on the side opposite to the side of the opening provided on the housing toward the second plate-shaped portion of the housing for engaging with a part of the second end portion of the housing.

12. An electrical connector according to claim 1, wherein the manipulatable releasing portion is provided with an engaging portion for engaging with a projection formed on the first plate-shaped portion of the housing.

13. An electrical connector according to claim 1, wherein the shell member is provided with a connecting portion for connecting the portion thereof provided for covering the first plate-shaped portion of the housing with another portion thereof provided to be close to the second plate-shaped portion of the housing at the side of the second end portion of the housing, said connecting portion being subjected to resilient deformation responding to swinging movements of the manipulatable releasing portion.

14. An electrical connector comprising:

a housing made of insulator and provided thereon with an opening through which a flat circuit device is inserted into the housing and which opens on a first end portion of the housing, a plurality of conductive contacts arranged on the housing, each of which has a connecting terminal portion projecting from a second end portion opposite to the first end portion of the housing to the outside of the housing and a press-contacting portion positioned in the housing to be operative to come into press-contact with a connecting terminal provided on the flat circuit device inserted in the housing through the opening provided thereon, and a shell member mounted on the housing for covering partially the same and provided in a body therein with a holding portion operative to be put in engagement with the flat circuit device inserted in the housing for holding the same and a manipulatable releasing portion formed to be manipulated for releasing the holding portion from the engagement with the flat circuit device inserted in the housing, wherein the holding portion is constituted to extend to be bent from an end of a portion of the shell member provided for covering a first plate-shaped portion of the housing toward a second plate-shaped portion opposite to the first plate-shaped portion of the housing so as to reach into an inside of the housing and to have an engaging projection formed thereon to be moved selectively for engaging with and disengaging from the flat circuit device inserted in the housing, and the manipulatable releasing portion is constituted with the portion of the shell member provided for covering the first plate-shaped portion of the housing to be operative to shift its position with the holding portion in a direction intersecting a direction along which the conductive contacts are arranged; and wherein the housing is provided with a claw-shaped holding portion for engaging with the portion of the shell member in which the holding portion is formed so as to hold the shell member.

15. An electrical connector according to claim 14, wherein each of the holding portion and the manipulatable releasing portion constitutes a resilient swingable portion.

16. An electrical connector according to claim 14, wherein the engaging projection is formed on an end of the holding portion on the side of the opening provided on the housing.

17. An electrical connector comprising:

a housing made of insulator and provided thereon with an opening through which a flat circuit device is inserted into the housing and which opens on a first end portion of the housing, a plurality of conductive contacts arranged on the housing, each of which has a connecting terminal portion projecting from a second end portion opposite to the first end portion of the housing to the outside of the housing and a press-contacting portion positioned in the housing to be operative to come into press-contact with a connecting terminal provided on the flat circuit device inserted in the housing through the opening provided thereon, and a shell member mounted on the housing for covering partially the same and provided in a body therein with a holding portion operative to be put in engagement with the flat circuit device inserted in the housing for holding the same and a manipulatable releasing portion formed to be manipulated for releasing the holding portion from the engagement with the flat circuit device inserted in the housing, wherein the holding portion is constituted to extend to be bent from an end of a portion of the shell member provided for covering a first plate-shaped portion of the housing toward a second plate-shaped portion opposite to the first plate-shaped portion of the housing so as to reach into an inside of the housing and to have an engaging projection formed thereon to be moved selectively for engaging with and disengaging from the flat circuit device inserted in the housing, and the manipulatable releasing portion is constituted with the portion of the shell member provided for covering the first plate-shaped portion of the housing to be operative to shift its position with the holding portion in a direction intersecting a direction along which the conductive contacts are arranged; and wherein the housing is provided with a portion thereof for covering an end face portion of the shell member constituted as a carrier-cut portion.

18. An electrical connector according to claim 17, wherein each of the holding portion and the manipulatable releasing portion constitutes a resilient swingable portion.

19. An electrical connector according to claim 17, wherein the engaging projection is formed on an end of the holding portion on the side of the opening provided on the housing.

* * * * *